US006487868B2

(12) United States Patent
Sato et al.

(10) Patent No.: US 6,487,868 B2
(45) Date of Patent: Dec. 3, 2002

(54) AIR CONDITIONER AND METHOD FOR CONTROLLING AIR CONDITIONER

(75) Inventors: Shigehiro Sato, Kusatsu (JP); Shiho Furuya, Kyoto (JP); Masahiro Watanabe, Otsu (JP); Toshiyuki Imasaka, Kusatsu (JP); Eiji Nakatsuno, Otsu (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/778,728

(22) Filed: Feb. 8, 2001

(65) Prior Publication Data

US 2001/0023593 A1 Sep. 27, 2001

(30) Foreign Application Priority Data

Mar. 6, 2000 (JP) ..... 2000-59971

(51) Int. Cl.[7] ..... F25B 49/00; F25D 17/04; F24F 3/16; A62B 7/08

(52) U.S. Cl. ..... 62/176.1; 62/78; 62/186; 62/303; 422/124; 422/125

(58) Field of Search ..... 62/264, 78, 303, 62/186; 96/16; 236/51; 239/60; 422/121, 186.3, 124, 125; 424/405; 454/233

(56) References Cited

U.S. PATENT DOCUMENTS 3,744,216 A * 7/1973 Halloran ..... 422/121
5,495,722 A * 3/1996 Manson et al. ..... 236/51
5,639,464 A * 6/1997 Terry et al. ..... 424/405
5,755,103 A * 5/1998 Na et al. ..... 62/264
5,788,569 A * 8/1998 Lee ..... 454/233
5,861,128 A * 1/1999 Vick et al. ..... 239/60
5,933,702 A * 8/1999 Goswami ..... 422/186.3
6,149,717 A * 11/2000 Satyapal et al. ..... 96/16

FOREIGN PATENT DOCUMENTS

JP 57-179522 * 11/1982
JP 9-126184 * 5/1997

* cited by examiner

*Primary Examiner*—William C. Doerrler
*Assistant Examiner*—Filip Zec
(74) *Attorney, Agent, or Firm*—Parkhurst & Wendel, L.L.P.

(57) ABSTRACT

To provide an air conditioner having an antibacterial and mold-proofing member which can be easily incorporated and has high effectiveness and a method for controlling the air conditioner. An air conditioner of the present invention having a heat exchanger and a blower for supplying the heat exchanger with air comprises an antibacterial and mold-proofing member which includes an antibacterial and mold-proofing component which will volatile at an ambient temperature and diffuse in the air conditioner, and also has a control mechanism for gradually evaporating which controls the release rate of the antibacterial and mold-proofing component to the inside of the air conditioner so that it becomes large at high humidity and small at low humidity.

14 Claims, 3 Drawing Sheets

AIR CONDITIONER AND METHOD FOR CONTROLLING AIR CONDITIONER

TECHNICAL FIELD

The present invention relates to an air conditioner capable of suppressing multiplication of bacteria and preventing growth of mold, and a method for controlling the air conditioner.

BACKGROUND ART

As a method for suppressing multiplication of bacteria and preventing growth of mold in an air conditioner, it is common to apply a compound of silver or copper and the like to a filter, heat exchanger, blower and the like in the air conditioner, thereby accomplishing antibacterial and mold-proofing finish. However, even in such air conditioners on which antibacterial and mold-proofing finish has been, there arose a problem that when dust accumulates after long time use, mold and the like propagate on the dust so that effect of the antibacterial and mold-proofing finish on the substrate is no longer exerted. In view of this, an antibacterial and mold-proofing mechanism that directly acts on the mold in the gas phase has been developed. More specifically, attempts have been made that by providing a discharge mechanism in indoor unit of an air conditioner or providing a UV lamp, ozone or negative ions are caused to generate for sterilizing bacteria or preventing propagation of mold.

For instance, in JP A9-119657, a mechanism for preventing microorganism propagation which causes negative ions to generate while decreasing concentration of ozone which is harmful to the human body is incorporated into a refrigerating and air conditioning system. In this case, the mechanism for preventing microorganism propagation having an ionization chamber for ionizing the gas in the air and an ozone separation chamber for removing ozone contained in the ionized gas is located at an outlet of a blower of a refrigerating unit.

However, such a mechanism for preventing microorganism propagation complicates the system and requires a certain size, so that there has been a problem that it cannot be incorporated into existent air conditioners.

DISCLOSURE OF THE INVENTION

It is an object of the invention to provide an air conditioner having an antibacterial and mold-proofing member which can be readily incorporated into the air conditioner and exhibits high effect.

In order to achieve this object, according to an air conditioner of the present invention, an air conditioner having a blower comprises an antibacterial and mold-proofing member which includes an antibacterial and mold-proofing component which will volatile and diffuse in the air conditioner, and is characterized in that the antibacterial and mold-proofing member has a control mechanism for gradually evaporating the antibacterial and mold-proofing component for making release rate of the antibacterial and mold-proofing component into the air conditioner in proportion to the humidity.

Since the air conditioner of the present invention has a control mechanism for gradually evaporating the antibacterial and mold-proofing component based on the humidity which makes release rate of the antibacterial and mold-proofing component into the air conditioner larger when the humidity is high and smaller when the humidity is low, it is possible to efficiently suppress growth of mold at high humidity where mold is more likely to grow. Furthermore, at low humidity, that is, where mold does not grow, release of the antibacterial and mold-proofing component is suppressed, making it possible to maintain the antibacterial and mold-proofing effect for a long time.

Furthermore, the air conditioner of the present invention is characterized in that the control mechanism for gradually evaporating includes a viscose-processed cellulose membrane. Since the control mechanism for gradually evaporating based on the humidity includes a viscose-processed cellulose membrane, it is possible to avoid the necessity of a humidity sensor or a driving apparatus and hence it is possible to reduce the cost.

Furthermore, the air conditioner of the present invention is characterized in that the antibacterial and mold-proofing member is formed by kneading the antibacterial and mold-proofing component with resin.

Furthermore, the air conditioner of the present invention is characterized in that the resin is wrapped with a membrane of which gas permeability has been controlled.

Since the antibacterial and mold-proofing member is formed by kneading the antibacterial and mold-proofing component with resin and the resultant component is wrapped with a membrane of which gas permeability has been controlled, it is possible to prevent the liquid antibacterial and mold-proofing component from leaking to the outside.

Furthermore, the air conditioner of the invention is characterized in that the antibacterial and mold-proofing component is isothiocyanates. Since the antibacterial and mold-proofing component is isothiocyanates, it is possible to efficiently suppress the growth of mold.

Furthermore, the air conditioner of the present invention is characterized in that concentration of the antibacterial and mold-proofing component in the air conditioner is equal to or more than 0.1 ppm when the humidity is equal to or more than 60% RH (relative humidity). By keeping the concentration of the antibacterial and mold-proofing component in the air conditioner equal to or more than 0.1 ppm when the humidity is equal to or more than 60% RH, it is possible to efficiently suppress the growth of mold.

The air conditioner of the present invention is characterized in that the antibacterial and mold-proofing member is enclosed in a case using at least one of polypropylene and vinyl chloride. Since the antibacterial and mold-proofing member is enclosed in the case using at least one of polypropylene and vinyl chloride, it is possible to prevent the antibacterial and mold-proofing member from being released more than necessary and prevent the case from deforming.

The air conditioner of the present invention is characterized in that an opening is provided in part of the case, and the control mechanism for gradually evaporating is provided at the opening. Since the opening is provided in part of the case and the control mechanism for gradually evaporating the antibacterial and mold-proof component based on the humidity is provided at the opening, the opening is directed to oppose the inside of the air conditioner so that it is possible to efficiently suppress the growth of mold.

The air conditioner of the present invention is characterized in that the opening is directed to oppose the inside of the air conditioner. Since the opening is directed to oppose the inside of the air conditioner, it is possible to increase the holdup of the antibacterial and mold-proofing component in the air conditioner and hence it is possible to suppress leakage to the outside of the air conditioner to the minimum.

The air conditioner of the present invention is characterized in that the antibacterial and mold-proofing member is provided at a position higher than a rotation center of the blower. Since the antibacterial and mold-proofing member is provided at the position higher than the rotation center of the blower, it is possible to suppress the growth of mold on the blower where mold is most likely to grow.

A method for controlling air conditioner according to the present invention is characterized in that after completion of cooling or dehumidifying operation, an outlet of the air conditioner is closed, and the blower is operated. By closing the outlet of the air conditioner and rotating the blower after completion of cooling or dehumidifying operation, concentration of the antibacterial and mold-proofing component is made uniform, and it is possible to realize an air conditioner having high mold growth preventing capability throughout the air conditioner.

Furthermore, the air conditioner of the present invention further comprises an air conditioner controlling program recording medium which stores a program for closing the outlet of the air conditioner and operating the blower after completion of cooling or dehumidifying operation.

EMBODIMENT OF THE INVENTION

Figure 1:
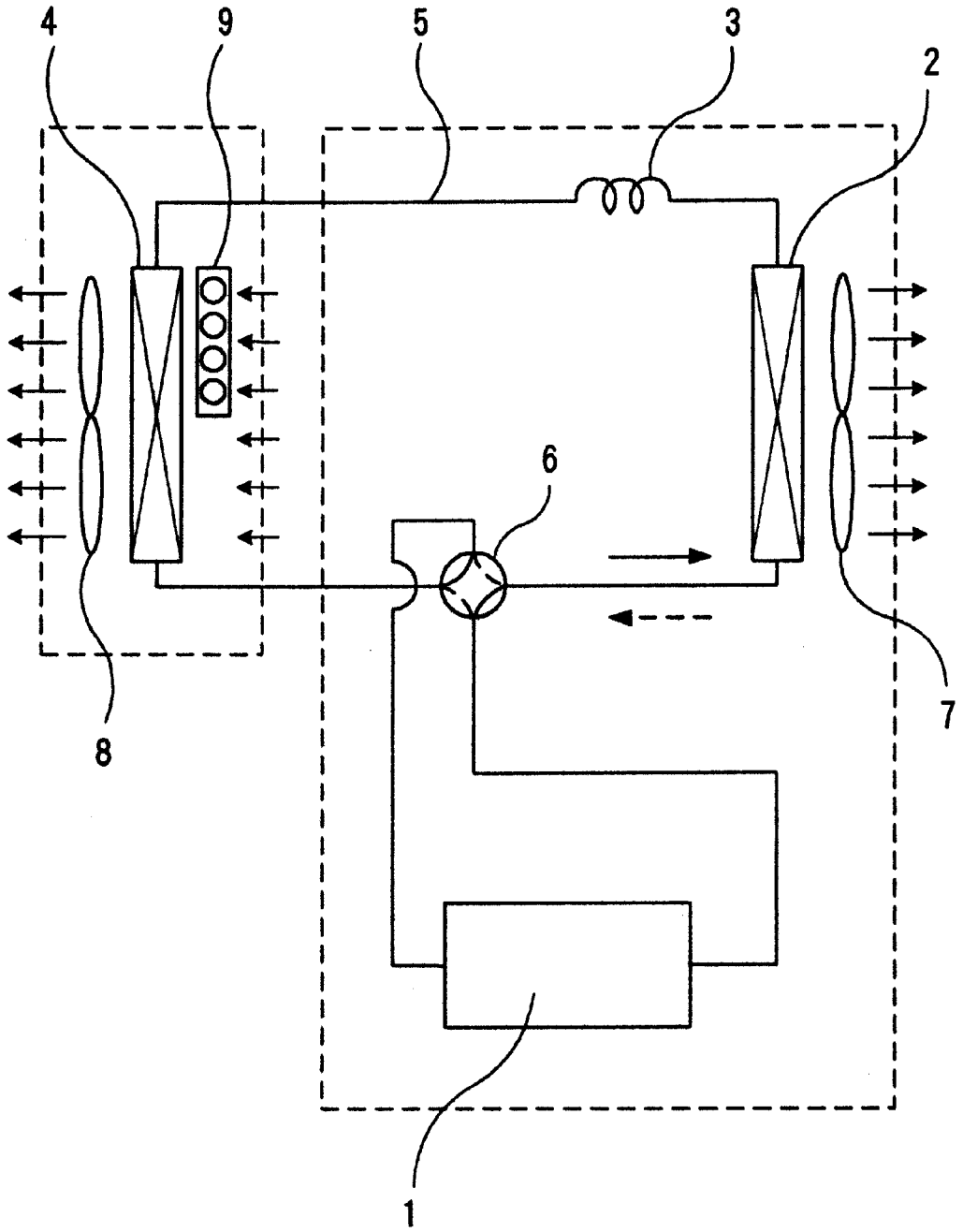
FIG. 1 is an overall view of a refrigeration cycle having an antibacterial and mold-proofing member according to one embodiment of the present invention.
Figure 2:
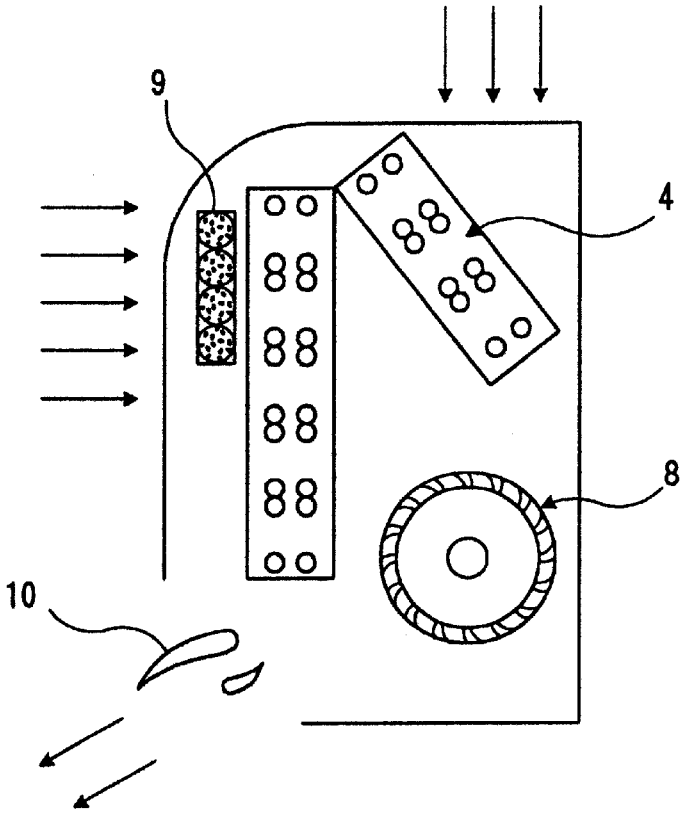
FIG. 2 is a section view of an indoor unit according to one embodiment of the present invention.
Figure 3:
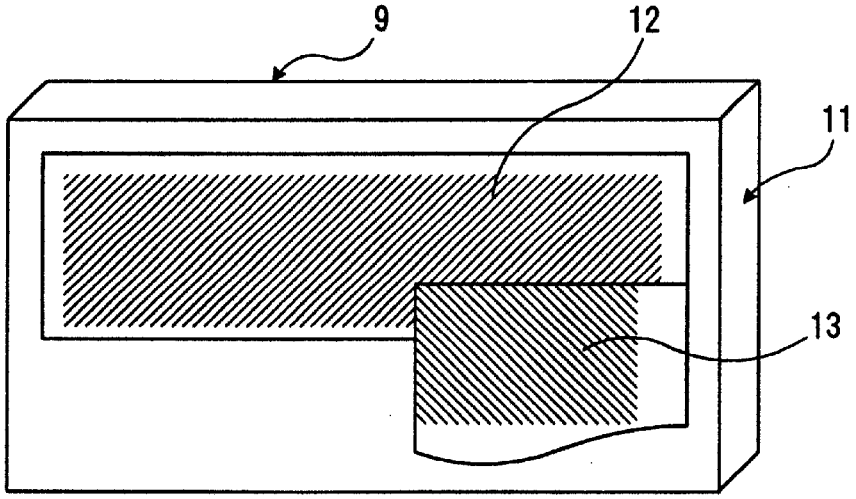
FIG. 3 is a structural view an antibacterial and mold-proofing member according to one embodiment of the present invention.

FIG. 1 is a structural view showing an embodiment of an air conditioner of the present invention, FIG. 2 is a section view of an indoor unit and FIG. 3 is a perspective view of an antibacterial and mold-proofing member. In the following, the present invention will be described with reference to FIGS. 1, 2 and 3.

FIG. 1 is an overall structural view of a refrigeration cycle having a refrigeration compressor, a condenser, an expansion mechanism, an evaporator and an antibacterial and mold-proofing member, which constitutes the air conditioner of the present invention.

The refrigeration cycle is composed of an indoor unit and an outdoor unit as shown in FIG. 1, wherein the outdoor unit has a refrigeration compressor 1, a condenser 2 and an expansion mechanism 3 such as capillary tube, and the indoor unit has an evaporator 4, all of which are connected via a tubing 5. Furthermore, the outdoor unit has a four-way valve 6, and by switching the valve 6, the flow of working medium is converted, thereby accomplishing conversion of the functions of the condenser 2 and the evaporator 4.

The condenser 2 and the evaporator 4 are provided with blowers 7, 8, respectively, which enable efficient heat exchange between air and the medium. In the air conditioner according to the present invention, an antibacterial and mold-proofing member 9 which will volatile at an ambient temperature and diffuse is provided in the indoor unit which performs heat exchange of the evaporator 4 by means of the blower 8.

FIG. 2 is a section view of the indoor unit in one embodiment of the present invention. In this drawing, the air flown into the indoor unit from outside from the front or from above by means of the blower 8 is brought into contact with the heat exchanger (evaporator) 4 and then blown off while being directed by a blowoff vane 10. In FIG. 2, the antibacterial and mold-proofing member 9 which will volatile at an ambient temperature and diffuse is provided on a path of air flowing from the outside front of the indoor unit.

As the antibacterial and mold-proofing member according to the present invention, any materials can be used as far as they contain an antibacterial and mold-proofing component which will volatile at an ambient temperature. For example, hinokitiol (2-hydroxy-4-(1-methlethyl)-2,4,6-cycloheptatrien-1-one), cinnamaldehyde, and isothiocyanates can be used, however, isothiocyanates which do not pollute the resin in the indoor unit of the air conditioner and exhibit antibacterial and mold-proofing properties at low concentration are most preferably used. Among the isothiocyanates, allyl isothiocyanate (3-Isothiocyanato-1-Propene), which is an odor component of horseradish, is most preferably used from the fact that it has high antibacterial and mold-proofing effect and high safety.

It is noted that among antibacterial and mold-proofing agents, those adversely affect the human body are not suited for use in a room where there exists a person. Furthermore, as it is desired that the action spectrum of the antibacterial and mold-proofing is wider, the effective action spectrum can be improved also by combining plural kinds of antibacterial and mold-proofing agents.

With regard to the inside of the air conditioner, since condensation occurs in the part of the evaporator 4, the humidity inside the indoor unit becomes high at the time of cooling or dehumidifying operation, which causes the problem of growth of mold. The growth rate of mold significantly changes with temperature and humidity. In general, the temperature is in the range of 20 to 30° C., the humidity is equal to or more than 70%, and the higher the temperature and the humidity are, the larger the growth rate of mold becomes. In the case of the antibacterial and mold-proofing member 9 of the present invention, a release rate of the antibacterial and mold-proofing component is controlled based on the ambient humidity. When the humidity is high, that is, the growth rate of mold is large, the release rate of the antibacterial and mold-proofing component is increased, while when the humidity is low, that is, the growth rate of mold is small, the release rate of the antibacterial and mold-proofing component is decreased. As a consequence, it becomes possible to prevent waste of the antibacterial and mold-proofing component and prolong the life of the antibacterial and mold-proofing member 9.

Control of the release rate of the antibacterial and mold-proofing component based on humidity may be realized in any procedure, however, the most preferable method is to wrap the antibacterial and mold-proofing component with a membrane, whose mesh size is variable based on the humidity, such as a viscose-processed cellulose membrane because such a method can be realized at a low cost. It seems that this viscose-processed cellulose membrane improves permeability of the gas of the antibacterial and mold-proofing component wrapped thereby because the polymeric mesh structure of the cellulose membrane becomes loose under high humidity.

Furthermore, it is most preferable that the antibacterial and mold-proofing member 9 of the present invention has a concentration such that the antibacterial and mold-proofing component has antibacterial and mold-proofing action, and that the antibacterial and mold-proofing component is gradually released so that it can be used as long as possible at a low concentration. As the procedure for gradually releasing the antibacterial and mold-proofing component, the antibacterial and mold-proofing agent adsorbed to a porous medium such as zeolite, or the antibacterial and mold-proofing component kneaded with resin having flexibility, and the antibacterial and mold-proofing component wrapped with a membrane for controlling gas permeability such as a cellulose membrane having a rough mesh structure are exemplified. Also these procedures can be used in combination. While the antibacterial and mold-proofing component may be applied on the resin, it is most preferable that the antibacterial and mold-proofing component kneaded into the resin is wrapped with the gas permeability controlling membrane. Kneading into the resin is preferable from the fact that it is possible to hold the antibacterial and mold-proofing component in relatively large amount and maintain the effect for a long time. Furthermore, the gas permeability controlling membrane is most preferable for preventing the antibacterial and mold-proofing component having high vapor pressure from being released more than necessary. As the gas permeability controlling membrane, PP, cellulose, cyclodextrin and the like can be used.

Furthermore, in the case where isothiocyanates are used as the antibacterial and mold-proofing component, it is necessary to make the concentration of the antibacterial and mold-proofing component inside the air conditioner equal to or more than 0.1 ppm for preventing growth of mold. During operation, the growth rate of mold is small because the temperature inside the air conditioner is low. In order to satisfy the above requirement, acceptable concentration of the antibacterial and mold-proofing component inside the air conditioner is equal to or more than 0.1 ppm after stopping the operation. In the case where the humidity inside the air condition is less than 60% RH, growth of mold is not observed. Therefore, it is necessary that the humidity of equal to or more than 60% RH and the concentration of the antibacterial and mold-proofing component is equal to or more than 0.1 ppm.

It is preferable that the antibacterial and mold-proofing member 9 of the present invention is enclosed in a case using at least one of polypropylene and vinyl chloride in consideration of the easiness of installation and compatibility with the resin inside the air conditioner. One example of the antibacterial and mold-proofing member 9 enclosed in a case is shown in FIG. 3. The antibacterial and mold-proofing member 9 is such that a member 13 obtainable by wrapping an antibacterial and mold-proofing component with a gas permeability controlling membrane is enclosed in a case 11. It is preferable that an opening is provided in part of the case 11, and a control mechanism for gradually evaporating 12 for gradually releasing volatile substances based on humidity is provided at the opening, from the view point of controllability of release. Although the control mechanism for gradually evaporating the antibacterial and mold-proofing component based on humidity may be of any type, a viscose-processed cellulose membrane of which gas permeability changes because the mesh thereof is loosen due to increase in humidity is desirable since it can be realized with low costs. It is preferable that opening is directed toward the inside of the air conditioner so as to fill the air conditioner with the antibacterial and mold-proofing component.

Mold is likely to grow in a portion where condensation occurs in the air conditioner, and more likely to grow on a cross flow fan (blower 8) than on the heat exchanger. Although condensation occurs also on the heat exchanger 4, the adhered condensation flows into a drain to wash out organic substances, so that organic substances are unlikely to remain on the fin of the heat exchanger 4. On the contrary, on the cross flow fan 8, the condensation water remains adhered and nutrients accumulate, so that mold is more likely to grow compared to the heat exchanger. For this reason, it is preferable that the antibacterial and mold-proofing member of the present invention is provided in the position higher than at least the cross flow fan 8 because the antibacterial and mold-proofing component is heavier than air.

Furthermore, it is possible to reduce the opening part of the indoor unit by closing the outlet by the blowoff vane 10 at the time of stopping operation and thereby to increase the holdup concentration of the antibacterial and mold-proofing component inside the indoor unit at the time of stopping operation. Therefore, the antibacterial and mold-proofing action sufficiently extends in the indoor unit, which is effective. Furthermore, rotating the cross flow fan while keeping the outlet closed by means of the blowoff vane 10 is preferable because the antibacterial and mold-proofing component can be uniformly spread in the entire air conditioner.

In the following, concrete examples will be disclosed.

EXAMPLE 1

A separate package of antibacterial and mold-proofing agent was prepared by kneading 2 g of allyl-isothiocyanate as an antibacterial and mold-proofing agent with resin and wrapping it with a cellulose membrane. A plurality of these separate packages were enclosed in a polypropylene case and a sealing portion of the case was adhered by welding.

An opening having a rectangular shape of 1400 $mm^2$ was formed in part of the polypropylene case, and a viscose-processed cellulose membrane of which gas permeability increases with humidity was adhered to the opening by welding, and the antibacterial and mold-proofing member 9 was prepared.

Figure 4:
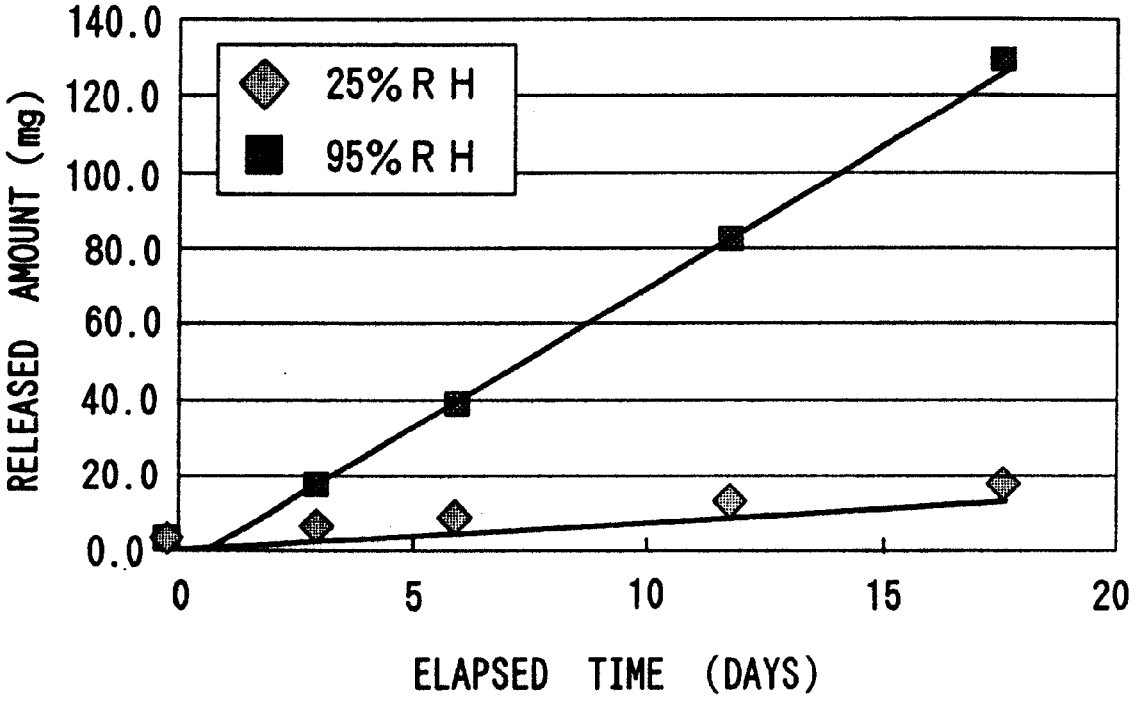
FIG. 4 is a graph comparing release rates of the antibacterial and mold-proofing component depending on humidity according to the present invention.

Then, how the release rate of the allyl-isothiocyanate changes with humidity was evaluated based on change in weight of the antibacterial and mold-proofing member 9. The result is shown in FIG. 4. As shown in this graph, under the humidity condition of 95% RH, the release rate was seven times what was obtained under the humidity condition of 25% RH.

This antibacterial and mold-proofing member 9 was mounted at a one-third position from the top of the middle portion of the indoor unit of a separate type air conditioner having a cooling capability of 2.5 kW. This position was 3 cm higher than the upper end of the cross flow fan 8. The concentration of allyl-isothiocyanate in the air conditioner was 1.2 ppm when the humidity inside the indoor unit was 95% RH.

EXAMPLE 2

A separate package of antibacterial and mold-proofing agent was prepared by kneading 2 g of the same allyl-isothiocyanate as that used in Example 1 with resin and wrapping it with a cellulose membrane. Then, this separate package was enclosed in a polypropylene case and a sealing portion of the case was sealed by welding.

Seventy circular openings of 20 $mm^2$ were formed in part of the polypropylene case, a viscose-processed cellulose membrane of which gas permeability increases with humidity was adhered to the opening by welding, and the antibacterial and mold-proofing member 9 was prepared. The release rate of the allyl-isothiocyanate changed with humidity in the same manner as in Example 1. This antibacterial and mold-proofing member 9 was mounted at a one-third position from the top of the middle portion of the indoor unit of a separate type air conditioner having a cooling capability of 2.5 kW as shown in FIG. 2. This position was 3 cm higher than the upper end of the cross flow fan. The concentration of allyl-isothiocyanate in the air conditioner was 1.5 ppm when the humidity inside the indoor unit was 95% RH.

EXAMPLE 3

A separate package of antibacterial and mold-proofing agent was prepared by kneading 2g of the same allyl-isothiocyanate as that used in Example 1 with resin and wrapping it with a cellulose membrane. Then, this separate package was enclosed in an engineering vinyl chloride case and a sealing portion of the case was sealed by welding.

A rectangular openings of 1400 $mm^2$ was formed in part of the engineering vinyl chloride case, a viscose-processed cellulose membrane of which gas permeability increases with humidity was adhered to the opening by welding, and the antibacterial and mold-proofing member was prepared. The release rate of the allyl-isothiocyanate changed with humidity in the same manner as in Example 1. This antibacterial and mold-proofing member 9 was mounted at a one-third position from the top of the middle portion of the indoor unit of a separate type air conditioner having a cooling capability of 2.5 kW as shown in FIG. 2. This position was 3 cm higher than the upper end of the cross flow fan. The concentration of allyl-isothiocyanate in the air conditioner was 1.0 ppm when the humidity inside the indoor unit was 95% RH.

EXAMPLE 4

With the same sample as prepared and used in Example 1, the cross flow fan 8 was slowly rotated for 5 minutes while keeping the outlet closed by the blowoff vane 10 after completion of cooling and dehumidifying operation. The concentration of allyl-isothiocyanate in the air conditioner was 0.9 ppm when the humidity inside the indoor unit was 95% RH.

Demonstration of Antibacterial and Mold-proofing Effect

On the top of the indoor unit of the air conditioner of Examples 1 to 4, a petri dish having a diameter of 100 mm in which mold collected from the inside of the air conditioner was cultured in a PDA culture medium was located so as to oppose the inside of the air conditioner. Under this condition, experiment was continued for one week by practicing cooling operation for only day-time 12 hours a day, while stopping the operation at other hours. As a comparative example, experiment was made under the same condition for the indoor unit of air conditioner not using the antibacterial and mold-proofing member 9.

After one week has elapsed, the petri dish in which the mold was cultured was removed, and an amount of discharged mold from the air conditioner was measured. The amount of discharged mold was measured by sampling, at the beginning of operating the air conditioner, the air of 80L for 2 minutes for one time by using an RCS air sampler available from BIOTEST. The sampling was conducted at the outlet of the air conditioner directly after the beginning of operation of the air conditioner. The culture medium used was a special medium for fungi. Cultivation at 25° C. was continued for 3 days. The results are represented by the number of colonies. As shown in Table 1, the number of colonies for the air conditioner of Examples 1 through 4 having the antibacterial and mold-proofing agent which will volatile at ambient temperature and diffuse in an air duct of the air conditioner was one or more order fewer than that of the comparative example which includes no antibacterial and mold-proofing agent. Thus, the antibacterial and mold-proofing effect was demonstrated. Since the number of fungi in a room was 5 (cfu/40L), it was found that the results of the Examples of the present invention are almost the same as that in the room in the number of fungi. Thus it is demonstrated that the present invention does not allow mold to grow.

TABLE 1

| | Number of discharged fungi (cfu/40 L) | | |
|---|---|---|---|
| | Directly after starting operation | After 10 minutes | After 20 minutes |
| Comparative Example | 45 | 19 | 10 |
| Example 1 | 0 | 0 | 0 |
| Example 2 | 0 | 0 | 0 |
| Example 3 | 2 | 1 | 1 |
| Example 4 | 3 | 2 | 2 |

In the above Examples, such a case as is using a separate type air conditioner was shown, however, the present invention may be applied to a vehicle air conditioner, a window-type integrated air conditioner, a package air conditioner, a humidifying unit and the like. Also these air conditioners may be provided at the air inlet opening thereof with the antibacterial and mold-proofing agent which will volatile at an ambient temperature and diffuse.

What is claimed is:

1. An air conditioner having a blower, additionally comprising:

an antibacterial and mold-proofing member, said member comprising an antibacterial and mold-proofing component for evaporating and diffusing the antibacterial and mold-proofing component into air in the air conditioner, wherein the antibacterial and mold-proofing member additionally comprising a control mechanism comprising a membrane having a gas permeability that increases with increasing humidity for gradually evaporating the antibacterterial and mold-proofing component into air inside the air conditioner at an evaporation rate that is proportioned to the humidity of said air.

2. The air conditioner according to claim 1, wherein the control mechanism for gradually evaporating comprises a viscose-processed cellulose membrane.

3. The air conditioner according to claim 1, wherein the antibacterial and mold-proofing component is combined with resin.

4. The air conditioner according to claim 3, wherein the resin is wrapped with said membrane.

5. The air conditioner according to claim 1, wherein the antibacterial and mold-proofing component comprises isothiocyanates.

6. The air conditioner according to claim 5, wherein concentration of the antibacterial and mold-proofing component in the air in the air conditioner is at least 0.1 ppm when the humidity is at least 60% RH.

7. The air conditioner according to claim 1, further comprising a case comprising a plastic selected from the group consisting of polypropylene and vinyl, the case enclosing the antibacterial and mold-proofing member.

8. The air conditioner according to claim 7, wherein the control mechanism comprises an opening in the case for gradually evaporating the antibacterial and mold-proofing component.

9. The air conditioner according to claim 8, wherein the opening communicates with the inside of the air conditioner.

10. The air conditioner according to claim 1, wherein the antibacterial and mold-proofing member is located at a position higher than the center of rotation of the blower.

11. A method for controlling the air conditioner comprising:

evaporating and diffusing an antibacterial and mold-proofing component from an antibacterial and mold-proofing member into air in an air conditioner, said member comprising an antibacterial and mold-proofing component enclosed in a membrane having a gas permeability that increases with increasing humidity, thereby controlling said evaporating and diffusing with said membrane so that an evaporation rate of said antibacterial and mold-proofing component is proportional to the humidity of said air.

12. The air conditioner according to claim 1, further comprising:

an air conditioner controlling program recording medium for storing a program for closing an outlet of the air conditioner and operating the blower after completion of cooling or dehumidifying operation.

13. The method of claim 11, further comprising closing an outlet of the air conditioner and operating the blower after completion of evaporating and diffusing an antibacterial and mold-proofing component into air.

14. The method of claim 13, further comprising performing the method of claim 13 automatically according to a stored program.

* * * * *